US006006406A

United States Patent [19]

Chung

[11] Patent Number: 6,006,406

[45] Date of Patent: Dec. 28, 1999

[54] POLYMERIC GROMMET

[75] Inventor: Do Jin Chung, Qingdao, China

[73] Assignee: Qingdao Gyoha Plastics Co., Ltd., China

[21] Appl. No.: 09/247,652

[22] Filed: Feb. 9, 1999

[51] Int. Cl.[6] ..... A43C 5/00; A44B 17/00; F16B 21/00

[52] U.S. Cl. ..... 24/713.6; 24/114.12; 24/623; 24/662; 24/459

[58] Field of Search ..... 24/713.6, 662, 24/114.12, 93, 459, 593, 694, 623

[56] References Cited

U.S. PATENT DOCUMENTS

| | | | |
|---|---|---|---|
| 615,336 | 12/1898 | Adams | 24/623 |
| 697,344 | 4/1902 | Leland | 24/713.6 |
| 2,821,764 | 2/1958 | Leahy et al. | 24/713.6 |
| 4,562,624 | 1/1986 | Kanzaka | 24/623 |
| 4,757,662 | 7/1988 | Gasser | 24/459 |
| 4,761,860 | 8/1988 | Krauss | 24/713.6 |
| 5,069,586 | 12/1991 | Casey | 24/713.6 |
| 5,647,107 | 7/1997 | Brewster | 24/713.6 |

*Primary Examiner*—Victor N. Sakran

*Attorney, Agent, or Firm*—Cislo & Thomas LLP

[57] ABSTRACT

A press machine for attachment of eyelets including a simple die configuration capable of allowing the user to easily carry out an eyelet attachment process on a table. The press machine includes a die having a rest room for receiving a washer fed from a washer box, a guide hole vertically formed through the rest room, and guide means for guiding the washer to the rest room, a table received in the rest room in such a fashion that it is vertically slidable, the table serving as a punch die for punching a cloth to be attached with eyelets while serving as a support for supporting the washer received in the rest room during an operation for attaching an eyelet to the cloth, a rack vertically mounted to a lower surface of the table in such a fashion that it is vertically slidable through the guide hole of the die in the rest room, a drive motor adapted to provide a drive force to the rack, the drive motor having a pinion engaged with the rack, and a control unit for controlling the drive motor. An eyelet is also provided which has a configuration capable of not only allowing the eyelet to be firmly attached to a cloth without being separated from the cloth due to an external force repeatedly applied to the eyelet or cloth, but also allowing the eyelet to be made of a material containing a large amount of polycarbonate.

6 Claims, 20 Drawing Sheets

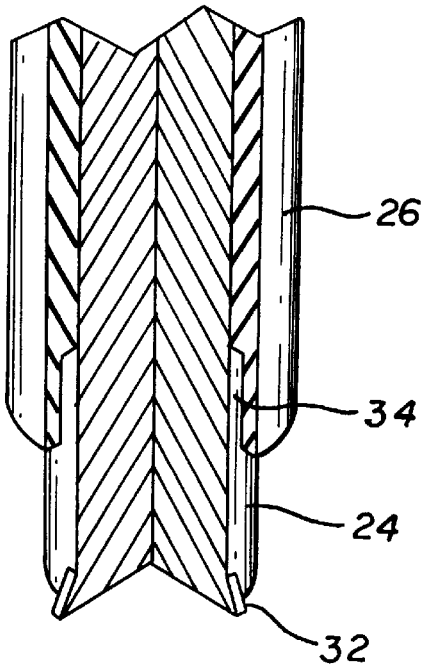
FIG. 6
FIG. 7
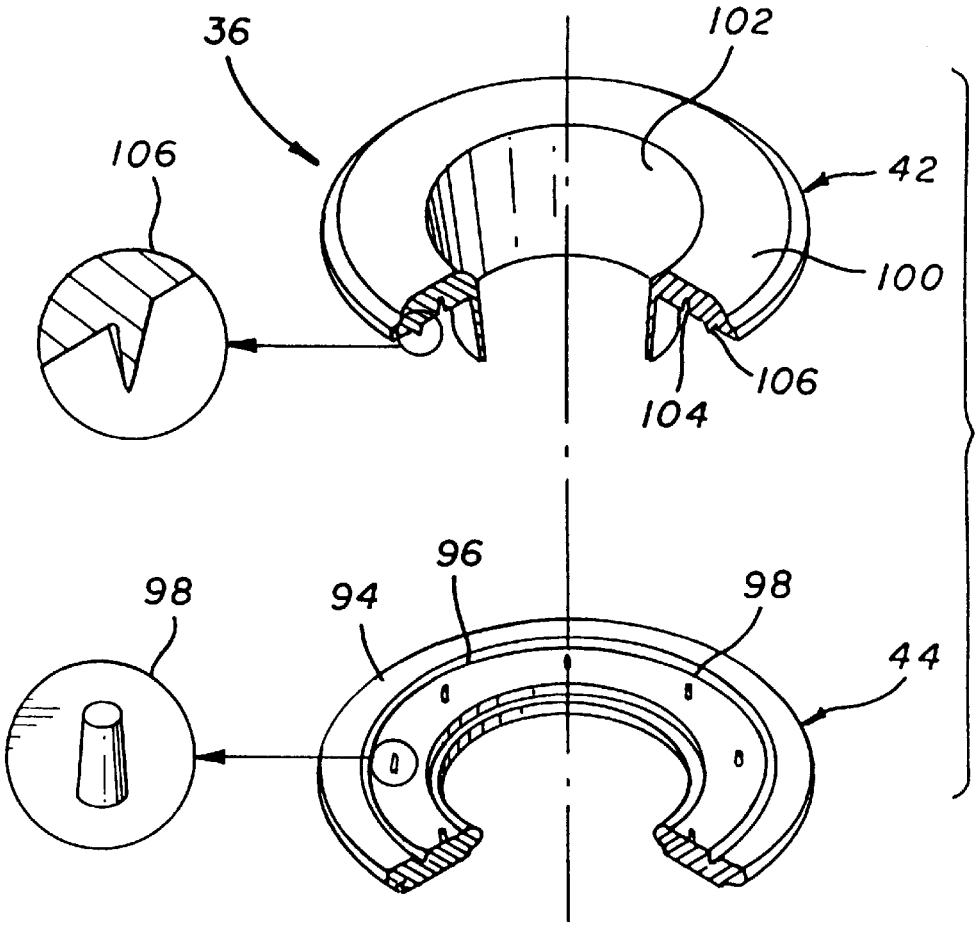

POLYMERIC GROMMET

BACKGROUND OF THE INVENTION

1. Field of the Invention

The present invention relates to eyelets and a press for attachment of such eyelets, and more particularly to a press machine for attachment of eyelets which is capable of allowing the eyelet attachment to be carried out using a single die, thereby achieving an improvement in the efficiency of the eyelet attachment. The present invention also relates to an eyelet having a configuration capable of not only allowing the eyelet to be firmly attached to a cloth without being separated from the cloth due to an external force repeatedly applied to the eyelet or cloth, but also allowing the eyelet to be made of a material containing a large amount of polycarbonate, thereby eliminating the requirement of disposing the eyelet separately from the cloth upon disposal of the cloth and pollution of the environment caused by the eyelet disposed.

2. Description of the Prior Art

Eyelets are generally attached to waterproof cloths used to cover articles placed in a storehouse or on a quay, beach, or pleasure ground, in order to firmly hold those waterproof cloths using wires. Such eyelets may also be attached to tents or covers for vehicles.

For attachment of such eyelets, press machines have been used. An example of a conventional press machine is disclosed in Korean Utility Model Publication No. 94-2209, which is incorporated herein by this reference thereto.

The press machine disclosed in the publication includes a table arranged at the front portion of a body of the machine. A die, which is used when punching a cloth to be attached with eyelets, is arranged on the table. Another die, which is used when attaching eyelets to the cloth, is arranged on the table. Rods are connected to the dies to transmit a drive force from a drive means mounted on the machine body to those dies, thereby laterally moving the dies, respectively.

A punch adapted to perforate a hole through the cloth and a press adapted to attach an eyelet to the cloth are arranged above the dies, respectively, in such a fashion that they can slide laterally together. The punch and press can also move vertically by a drive force transmitted thereto from another drive means.

Now, the operation of the press machine having the above-mentioned configuration will be described.

SUMMARY OF THE INVENTION

First, a cloth is laid on the punching die. When the press machine then operates, the punch perforates a hole through the cloth while moving downwardly.

After the punching operation, the base of an eyelet is laid on the cloth in such a fashion that it is vertically aligned with the hole. The washer of the eyelet is also arranged in the second die in such a fashion that it is vertically aligned with the hole.

As the press machine further operates, the rods advance by virtue of a drive force transmitted from the drive means, thereby causing the punching die to be laterally shifted. At the same time, the second die, which serves to couple the elements of the eyelet, is disposed beneath the press.

When the press machine further operates under the condition in which the dies are adjusted in position as mentioned above, both the punch and press move downwardly, thereby depressing the upper surface of the base. As a result, the lower end of the base passes through the hole of the cloth and then fits around the washer. Thus, the eyelet is firmly fixed to the cloth.

A plurality of eyelets is attached to the cloth in the above-mentioned manner while being uniformly spaced from one another in accordance with the using purpose thereof.

However, the above-mentioned conventional pressing machine has a complicated arrangement in which a pair of laterally slidable dies is used to attach an eyelet to a cloth. As a result, there is a drawback in that a degradation in workability occurs.

Since the dies serve to attach an eyelet to a cloth while sliding laterally, the resulting attachment of the eyelet may be unstable. This may result in an easy separation of the eyelet from the cloth.

Meanwhile, a variety of eyelet configurations have been proposed. An example of a conventional eyelet configuration is disclosed in Korean Utility Model Laid-open Publication No. 95-14715.

The eyelet disclosed in the publication includes a flange member and a cap both made of a metal. The flange member is provided at its upper surface with repeated grooves and protrusions. The flange member is also provided at its central portion with a vertically extending bushing. The bushing is integral with the flange member and has a central through hole. An annular engaging protrusion is also formed on the outer surface of the bushing.

The cap is provided at its lower surface with repeated grooves and protrusions engagable with the grooves and protrusions of the flange member. The cap also has, at its central portion, a through hole communicating with the through hole of the flange member.

An annular engaging groove is formed at the inner surface of the through hole of the cap. The engaging protrusion of the bushing is engagable with the engaging groove.

The procedure for attaching the eyelet having the above-mentioned configuration to a cloth will now be described.

First, the bushing of the flange member is fixed to a punched portion of the cloth in such a fashion that the grooves and protrusions formed at the upper surface of the flange member are in close contact with the lower surface of the cloth.

Thereafter, the cap is fitted around the bushing of the flange member fixed to the cloth in such a fashion that the bushing is inserted into the through hole of the cap until the engaging protrusion of the bushing engages with the engaging groove of the cap. In this state, the grooves and protrusions formed at the lower surface of the cap are in close contact with the upper surface of the cloth.

Since the eyelet has a configuration in which the engaging protrusion of the bushing engages with the engaging groove of the cap, there is a problem in that the engaging protrusion may be easily disengaged from the engaging groove due to an external force repeatedly applied to the eyelet. In this case, the eyelet may be separated from the cloth.

Meanwhile, the eyelet attached to the cloth may be in an upright state when the cloth is folded. In this state, if the cloth is forcibly folded while being pressed, the upright cloth may then cause the cloth to be damaged. The user, who holds the cloth, may also receive injury to his hand by the eyelet.

Where the cloth is disposed of at the end of the life span thereof, unless the eyelet is separated from the cloth, the eyelet may cause pollution of the environment because it is made of a metal. Although this problem may be solved by disposing the eyelet separately from the cloth, this separation work is troublesome.

OBJECTS OF THE INVENTION

Therefore, an object of the invention is to provide a press machine for eyelets including a simple die configuration capable of allowing the user to easily carry out an eyelet attachment process on a table.

Another object of the invention is to provide an eyelet having a configuration capable of not only allowing the eyelet to be firmly attached to a cloth without being separated from the cloth due to an external force repeatedly applied to the eyelet or cloth, but also allowing the eyelet to be made of a material containing a large amount of polycarbonate, thereby eliminating the requirement of disposing the eyelet separately from the cloth upon disposal of the cloth and pollution of the environment caused by the eyelet disposed.

Another object of the invention is to provide an eyelet having a configuration capable of preventing the eyelet from damaging the cloth or the hand of the user when the cloth is folded for storage thereof.

In accordance with one aspect, the present invention provides a press machine for attachment of eyelets comprising: a body having a rest room for receiving a washer fed from a washer box, a guide hole vertically formed through the rest room, and guide means for guiding the washer to the rest room; a table received in the rest room in such a fashion that it is vertically slidable, the table serving as a punch die for punching a cloth to be attached with eyelets while serving as a support for supporting the washer received in the rest room during an operation for attaching an eyelet to the cloth; a rack vertically mounted to a lower surface of the table in such a fashion that it is vertically slidable through the guide hole of the die in the rest room; a drive motor adapted to provide a drive force to the rack, the drive motor having a pinion engaged with the rack; and a control unit for controlling the drive motor.

In accordance with another aspect, the present invention provides an eyelet comprising: an annular rim adapted to be in close contact with an upper surface of a cloth, to be attached with the eyelet, in an urging state; a plurality of uniformly spaced prongs downwardly protruded from a lower surface of the rim and adapted to be stuck in the cloth, each of the prongs having a radially outwardly inclined shape; a boss extending downwardly from an inner edge of the rim, the boss being fitted in a hole formed through the cloth; a flange adapted to be in close contact with a lower surface of the cloth; and a plurality of pushing protrusions upwardly protruded from an upper surface of the flange and arranged radially inwardly of the prongs, the pushing protrusions serving to push the lower surface of the cloth.

Other objects and aspects of the invention will become apparent from the following description of embodiments with reference to the accompanying drawings in which:

BRIEF DESCRIPTION OF THE DRAWINGS

FIG. 6 is a partially-broken perspective view illustrating a part of a press according to the present invention;

FIG. 7 is an exploded perspective view illustrating an eyelet according to the present invention;

DESCRIPTION OF THE PREFERRED EMBODIMENT(S)

Figure 1:
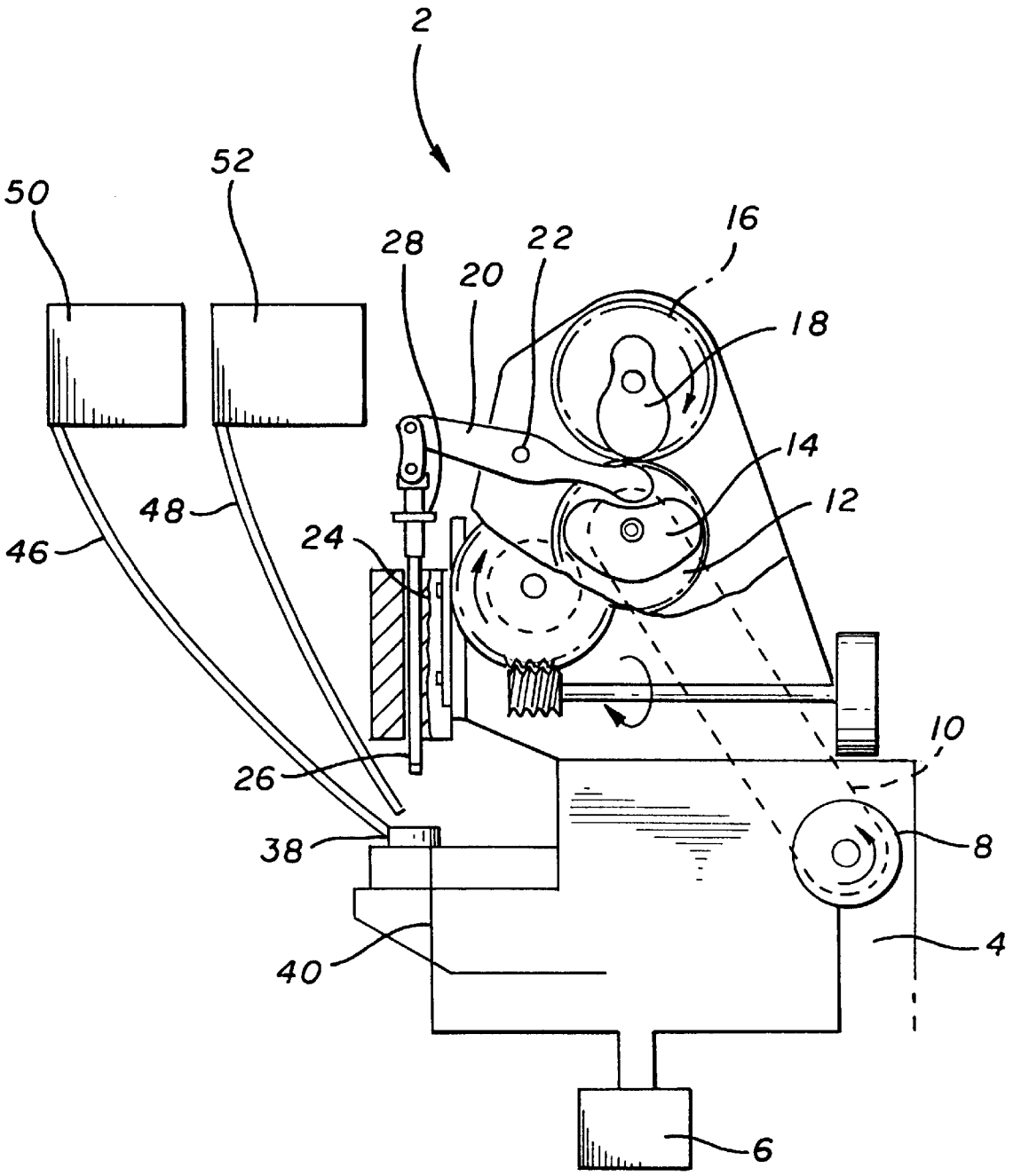
FIG. 1 is a schematic view illustrating a press machine according to the present invention.
Figure 2:
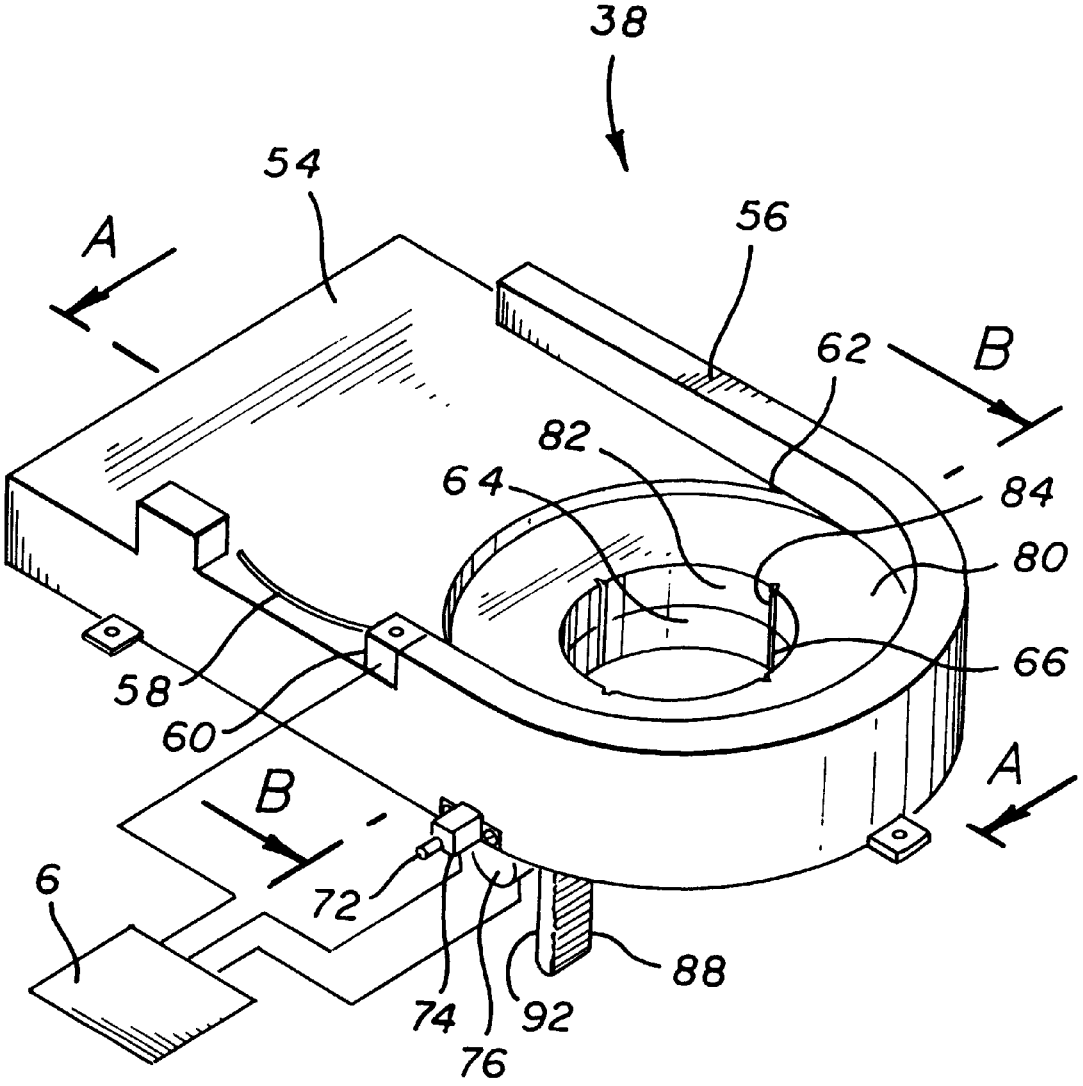
FIG. 2 is a perspective view illustrating a die according to the present invention.
Figure 3:
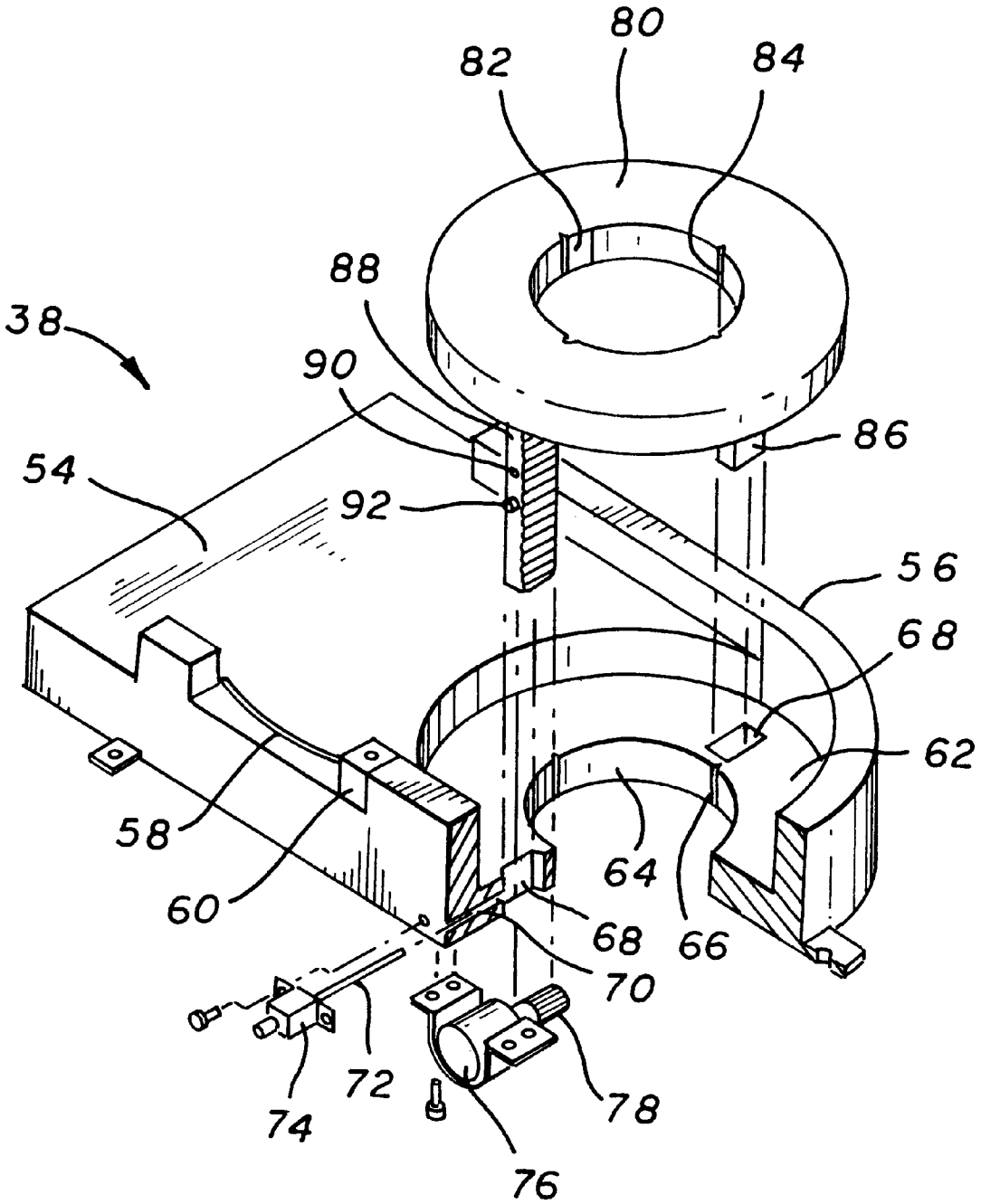
FIG. 3 is an exploded perspective view illustrating the die shown in FIG. 2.
Figure 4:
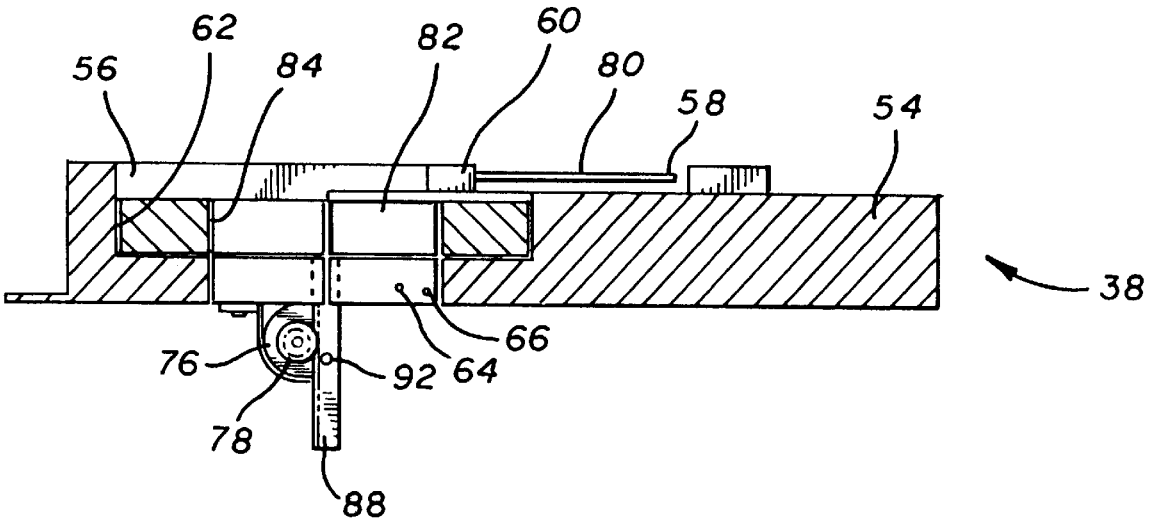
FIG. 4 is a cross-sectional view taken along the line A—A of FIG. 2.
Figure 5:
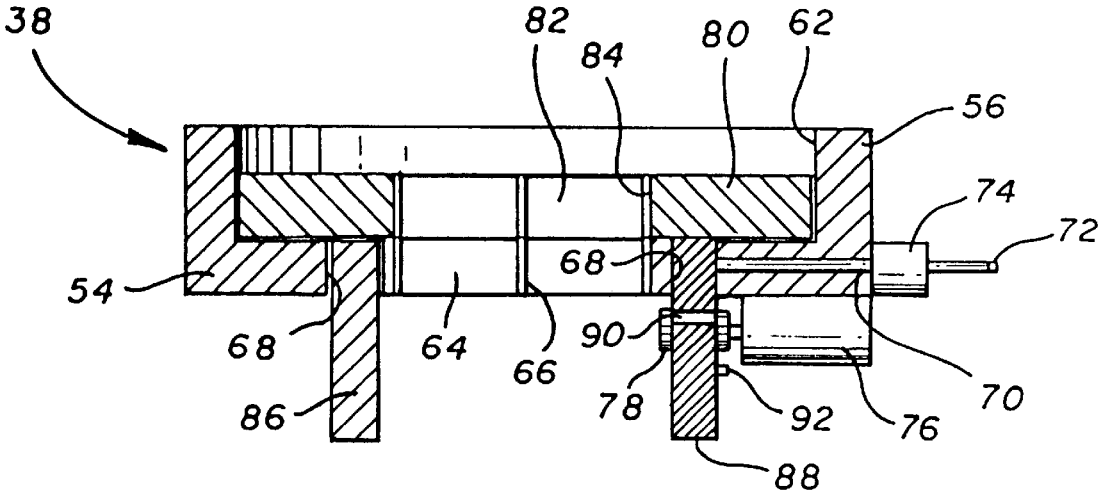
FIG. 5 is a cross-sectional view taken along the line B—B of FIG. 2.

Referring to FIGS. 1 to 6, a press machine for attachment of eyelets according to the present invention is illustrated.

As shown in the drawings, the press machine, which is denoted by the reference numeral 2, includes a machine body 4, and a control unit 6 installed on the machine body 4 and adapted to carry out the entire control operation for the press machine.

A first drive motor 8 is mounted to the machine body 4. The first drive motor 8 operates under the control of the control unit 6, thereby generating a drive force.

A belt 10 is connected at one side thereof to a drive shaft of the first drive motor 8. The belt 10 is also connected at the other side thereof to a first gear wheel 12 rotatably mounted to the machine body 4. By this configuration, the drive force from the first drive motor 8 is transmitted to the first gear wheel 12 via the belt 10. A first cam 14 is provided at the first gear wheel 12.

A second gear wheel 16 is rotatably mounted to the machine body 4 in such a fashion that it engages with the first gear wheel 12. The second gear wheel 16 is provided with a second cam 18 having a function similar to that of the first cam 14.

A lever 20 is also hingably mounted to the machine body 4 by means of a hinge pin 22 in such a fashion that one end thereof is arranged between the first and second cams 14 and 18. The other end of the lever 20 is connected to the upper end of a punch 24 by means of a link. The punch 24 extends vertically through a through hole vertically formed through a press 26 vertically slidably mounted to the machine body 4. The punch 24 is vertically slidable through the through hole of the press 26.

A locker 28 is mounted to the upper portion of the punch 24. The locker 28 serves to selectively lock the press 26 to the punch 24 in accordance with the using purpose of the press machine. When the punch 24 moves downwardly in a locking state of the locker 28, the press 26 moves downwardly along with the punch 24. When the locker 28 is in a lock-releasing state, the punch 24 alone moves downwardly.

The punch 24 is provided at its lower end with a plurality of uniformly spaced rakes 32 adapted to partially cut the portion of a cloth 30 corresponding to the edge of a hole to be perforated through the cloth 30. Vertical grooves 34 are formed at the inner surface of the through hole of the press 26 at the lower end of the press 26 in order to receive the rakes 32 of the punch 24.

A die 38, which serves to attach an eyelet 36 to the cloth 30, is arranged beneath the press 26. The die 38 is mounted on a table 40 arranged at the front portion of the machine body 4.

A pair of chutes 46 and 48 are arranged at one side of the table 40 to guide the elements of the eyelet 36 (namely, a base 42 and a washer 44) fed to the table 40, respectively. Respective lower ends of the chutes 46 and 48 are positioned in the vicinity of the table 40 whereas respective upper ends of the chutes 46 and 48 are connected to a pair of boxes 50 and 52 in which washers 44 and bases 42 are contained, respectively.

Now, the construction of the die 38 mounted on the table 40 will be described in detail.

The die 38 includes a die body 54, and a guide wall 56 formed on the upper surface of the die body 54 along both lateral ends and front end of the die body 54. The guide wall 56 serves to guide a washer 44 fed to the die body 54 via the chute 46. An arm 58 is hingably mounted to one lateral end of the die body 54 to firmly hold the washer 44 fed to the die body 54 at a desired position. The arm 58 is coupled to a first solenoid 60 fixedly mounted to the guide wall 56. The first solenoid 60 serves to provide a drive force for hingably moving the arm 58.

A rest room 62 is formed at the front portion of the die body 54. A through hole 64 is centrally formed in the rest room 62 through the die body 54. A plurality of uniformly spaced guide grooves 66 is formed at the inner surface of the through hole 64 in such a fashion that they extend vertically.

A pair of guide holes 68 is formed through the die body 54 at opposite sides of the rest room 62, respectively. Another guide hole 70 extends laterally through the die body 54 from one lateral surface of the die body 54 in such a manner that it communicates with one of the guide holes 68.

A bar 72 is slidably received in the guide hole 70 in such a fashion that its inner end extends selectively into the guide hole 70. The bar 72 is coupled to a second solenoid 74 at its outer end outwardly protruded from the die body 54. The second solenoid 74, which is mounted to one lateral surface of the die body 54, serves to provide a drive force for slidably moving the bar 72.

A second drive motor 76 is fixedly mounted to the lower surface of the die body 54 to generate a desired drive force. A pinion 78 is fixedly mounted to a drive shaft of the second drive motor 76. The second drive motor 76 and the first and second solenoids 60 and 74 are electrically connected to the control unit 6.

A table 80 is seated in the rest room 62 in such a fashion that it is vertically movable. The table 80 serves to support the cloth 30 during a punching operation. The table 80 is centrally provided with a through hole 82 through which the punch 24 can pass. A plurality of uniformly spaced guide grooves 84 are formed on the inner surface of the through hole 82 in such a fashion that they are vertically aligned with the guide holes 66. The guide grooves 66 and 84 serve to guide the rakes 32 while receiving those rakes.

A vertical bar 86 and a rack 88 are mounted to the lower surface of the table 80 in such a fashion that they extend vertically through the guide holes 68, respectively. The rack 88 engages with the pinion 78 so that it moves vertically by a rotation of the pinion 78. By virtue of the vertical movement of the rack 88, the table 80 moves vertically with respect to the rest room 62.

The rack 88 is provided at one lateral surface thereof with a laterally extending hole 90 in which the inner end of the bar 72 coupled to the second solenoid 74 is selectively inserted. The rack 88 is also provided at the same lateral surface thereof with a stopper pin 92 arranged below the hole 90. The stopper pin 92 serves to limit a raised position of the table 80.

Preferably, the stopper pin 92 is arranged at a position corresponding to a raised position of the table 80 where the upper surface of the table 80 is flush with the upper surface of the guide wall 56.

The construction of the eyelet 36 according to the present invention will now be described in conjunction with FIG. 7.

In accordance with the present invention, the eyelet 36 is made of a material containing a large amount of polycarbonate. As mentioned above, the eyelet 36 includes the washer 44 arranged on the lower surface of the cloth 30, and the base 42 arranged on the upper surface of the cloth 30.

The washer 44 includes an annular flange 94 and an annular groove 96 formed on the upper surface of the flange 94. A plurality of uniformly spaced pushing protrusions 98 are upwardly protruded from the upper surface of the flange 94 radially inwardly of the groove 96. The pushing protrusions 98 have a taper shape in such a fashion that they have a reduced width as they extend upwardly. The pushing protrusions 98 serve to upwardly push the lower surface of the cloth 30, thereby firmly holding the cloth 30 without any movement.

On the other hand, the base 42 includes an annular rim 100, a boss 102 extending downwardly from the inner edge of the rim 100, and an annular groove 104 formed on the lower surface of the rim 100 radially outwardly of the boss 102. The annular groove 104 serves to receive the upper end of each pushing protrusion 98 formed on the washer 44. The boss 102 has a truncated conical shape in such a fashion that it has a reduced cross-sectional area as it extends downwardly.

A plurality of uniformly spaced prongs 106 is downwardly protruded from the lower surface of the rim 100 radially outwardly of the groove 104. The prongs 106 are stuck in the cloth 30 when the eyelet 36 is attached to the cloth 30. The prongs 106 have an inwardly inclined shape and are integral with the rim 100.

The pushing protrusions 98 formed on the washer 44 are arranged inwardly of the prongs 106 formed on the base 42 in a state in which the base 42 and washer 44 are coupled together.

Figure 8A:
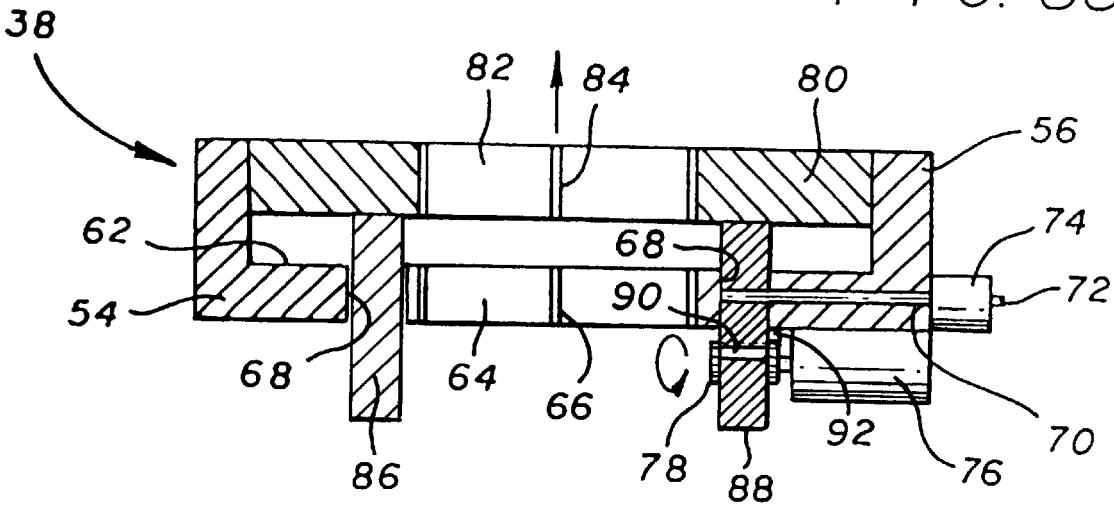
FIGS. 8*a* to 8*h* are schematic views respectively illustrating the operation of the press machine according to the present invention.
Figure 8B:
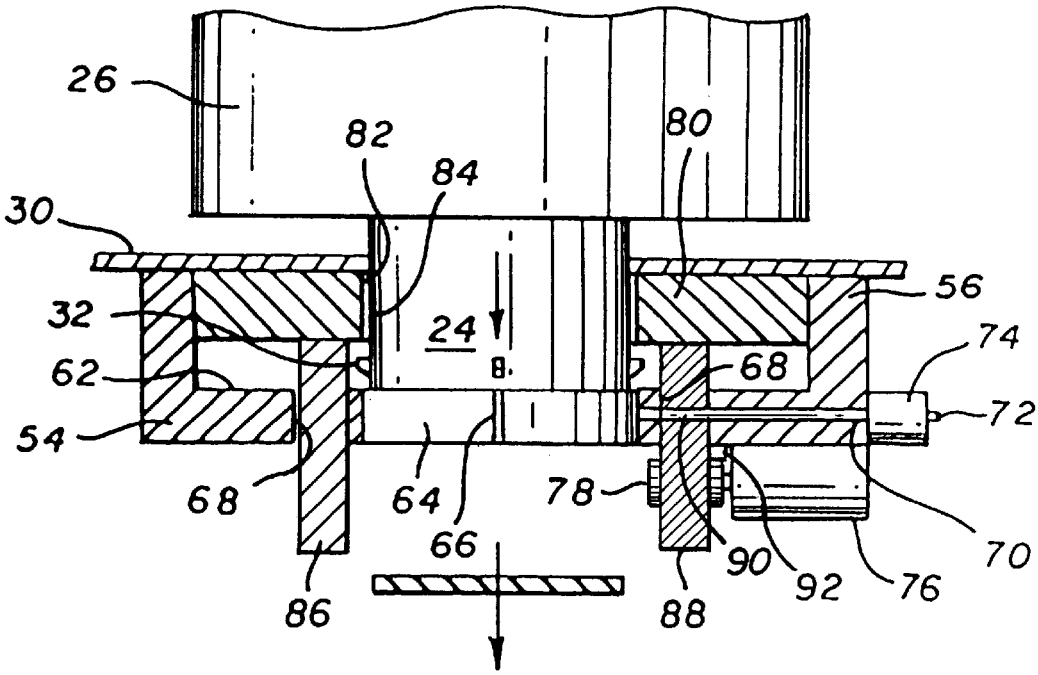
Figure 8C:
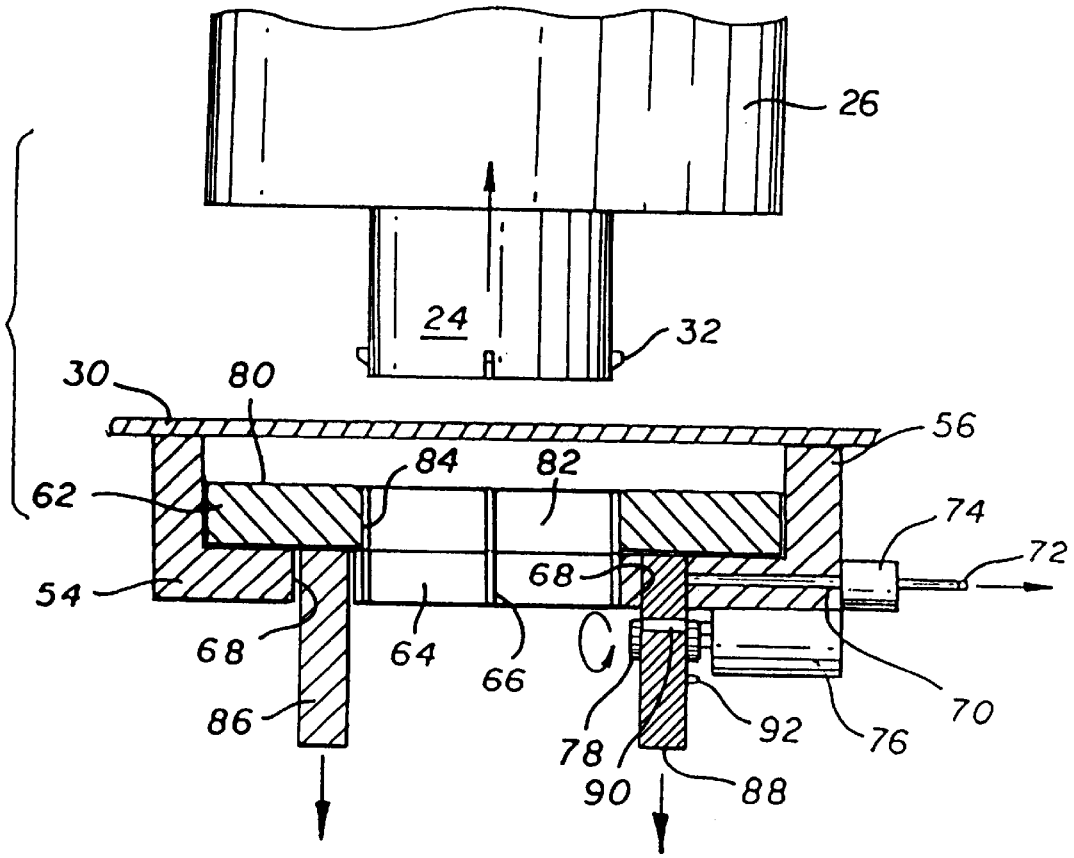
Figure 8D:
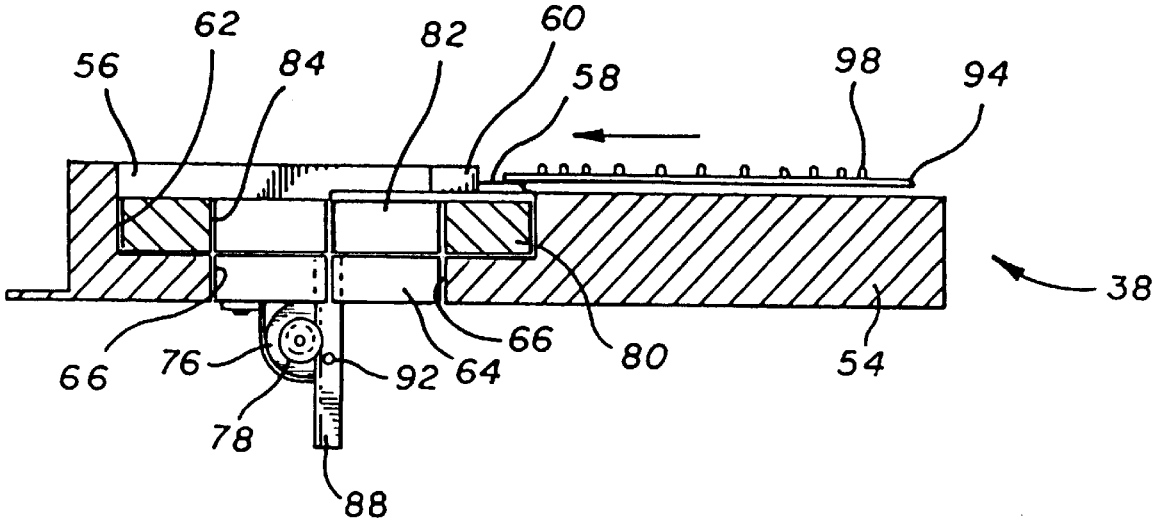

Hereinafter, the operation of the pressing machine for attaching the eyelet having the above-mentioned construction to a cloth in accordance with the present invention will be described in conjunction with FIGS. 8*a* to 8*h*. The operation of the pressing machine is controlled by the operation of the control unit 6 carried out as shown in FIG. 9.

First, the cloth 30, which is to be attached with eyelets, is laid on the die 38. For a punching operation, the table 80 should be positioned at its raised position. Accordingly, when the table 80 is positioned at a seated position in the rest room 62, it is required to move the table 80 to its raised position. At the seated position of the table 80, the bar 72 is in a retracted state in which its inner end is separated from the hole 90 of the rack 88 to allow the rack 88 to move. The retraction of the bar 72 is carried out under the control of the control unit 6. That is, when a power switch (not shown) is switched on, the control unit 6 energizes the second solenoid 74 which, in turn, retracts the bar 72. Accordingly, the inner end of the bar 72 is separated from the hole 90 of the rack 88. This state is kept until the second solenoid 74 is de-energized under the control of the control unit 6.

After the cloth 30 is laid on the die 38, the second drive motor 76 drives under the control of the control unit 6, thereby rotating the pinion 78. By the rotation of the pinion 78, the rack 88 moves upwardly.

As a result, the table 80 moves upwardly from the rest room 62 along with the bar 86. At this time, the upward movement of the table 80 is guided by the bar 86 and rack 88 moving upwardly along the guide holes 68.

When stopper pin 92 provided at the rack 88 comes into contact with the lower surface of the die body 54 during the upward movement of the rack 88, a further movement of the rack 88 is prevented. In response to this state, the second drive motor 76 stops after a predetermined time set by the control unit 6 elapses.

Thereafter, the control unit 6 sends a control signal to the second solenoid 74 to de-energize the second solenoid 74, thereby causing the bar 72 to extend. Accordingly, the inner end of the bar 72 is inserted into the hole 90 of the rack 88.

Accordingly, the table 80 is locked at the raised position by the bar 72.

At the raised position, the table 80 is positioned in such a fashion that its upper surface is flush with the upper surface of the guide wall 56.

After completing the above operation, a portion of the cloth 30 to be punched is disposed over the table 80.

In this state, the first drive motor 8 drives under the control of the control unit 6, thereby generating a drive force. The drive force from the first drive motor 8 is transmitted to the gear wheels 12 and 16 via the belt 10. Accordingly, the gear wheels 12 and 16 rotate along with their cams 14 and 18. The rotating force of the cams 14 and 18 is transmitted to one end of the lever 20 interposed between the cams 14 and 18, thereby causing the lever 20 to hinge about the hinge pin 22.

The drive force of the lever 20 is transmitted to the punch 24 connected to the other end of the lever 20 in the form of a downward movement force. Where the locker 28 is in a lock-releasing state, accordingly, the punch 24 alone moves downwardly, as shown in FIG. 8*b*. At this time, the press 26 does not move.

When the punch 24 moves downwardly, the rakes 32 provided at the lower end of the punch 24 are separated from the grooves 34 provided at the lower end of the press 26. As the punch 24 further moves downwardly, its lower end punches the portion of the cloth 30 laid on the table 80 and passes through the punched cloth portion.

At this time, the rakes 32 partially cut the edge of a hole formed through the cloth 30 by the punching operation. The resulting cuts serve to allow the base 42 of the eyelet 36 to pass through the hole during a subsequent coupling operation for the base 42.

The punch 24 further moves downwardly through the through holes 82 and 64 of the table 80 and die body 54, so that a cloth piece separated from the punched cloth 30 is outwardly discharged from the through hole 64 of the die body 54.

After completing the punching operation, the punch 24 returns to its original position by the drive force of the lever 20 transmitted thereto in the form of an upward movement force by virtue of the camming function of the cams 14 and 18 rotating continuously by the drive force from the first drive motor 8.

In this state, the control unit 6 sends a control signal to the second solenoid 74 to retract again the bar 7, thereby allowing the rack 88 to move. At the same time, the control unit 6 also sends a control signal to the second drive motor 76 in order to reversely rotate the pinion 78.

As the pinion 78 rotates reversely, the rack 88 engaged with the pinion 78 moves downward along with the bar 86 and table 80. Accordingly, the table 80 returns to a state in which it is seated in the rest room 62, as shown in FIG. 8*c*.

At the seated state of the table 80, the upper surface of the table 80 is positioned at a level lower than the upper surface of the die body 54 by a desired distance.

After completing the above operation, a washer 44 is discharged from the first box 50 which operates in a vibrating manner. The discharged washer 44 is downwardly fed to the die body 54 via the first chute 46 and then guided by the guide wall 56 of the die body 54. Thus, the washer 44 reaches the table 80, as shown in FIG. 8*d*.

Figure 8E:
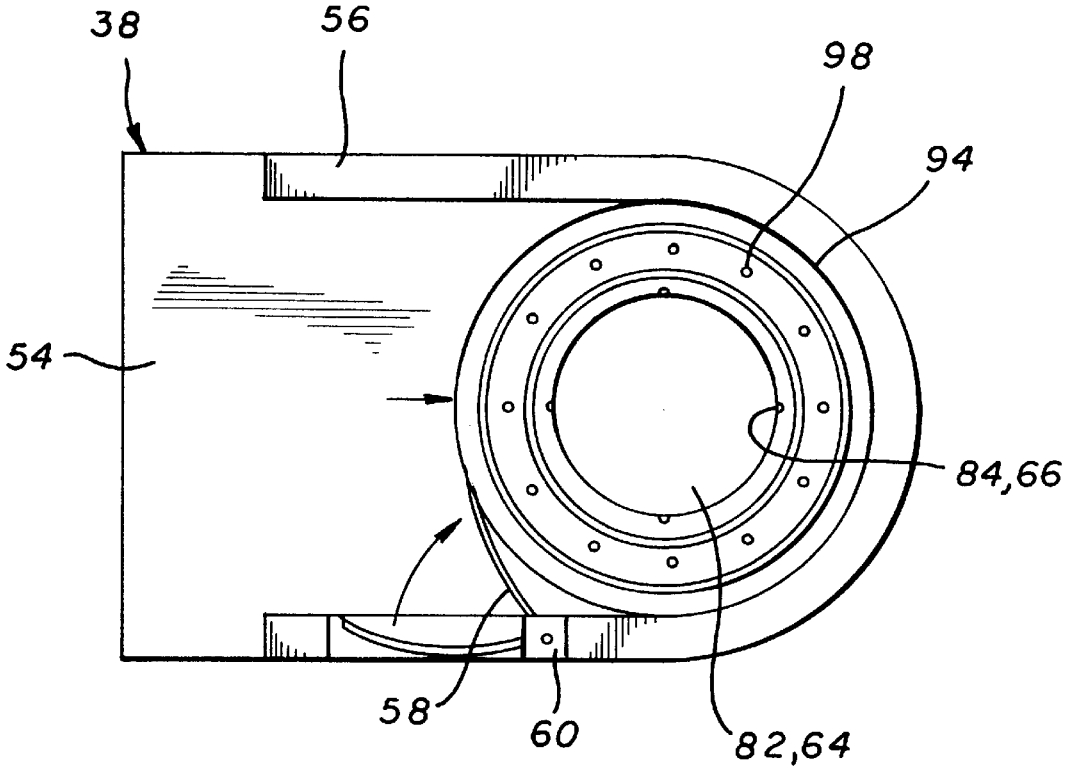
Figure 9:
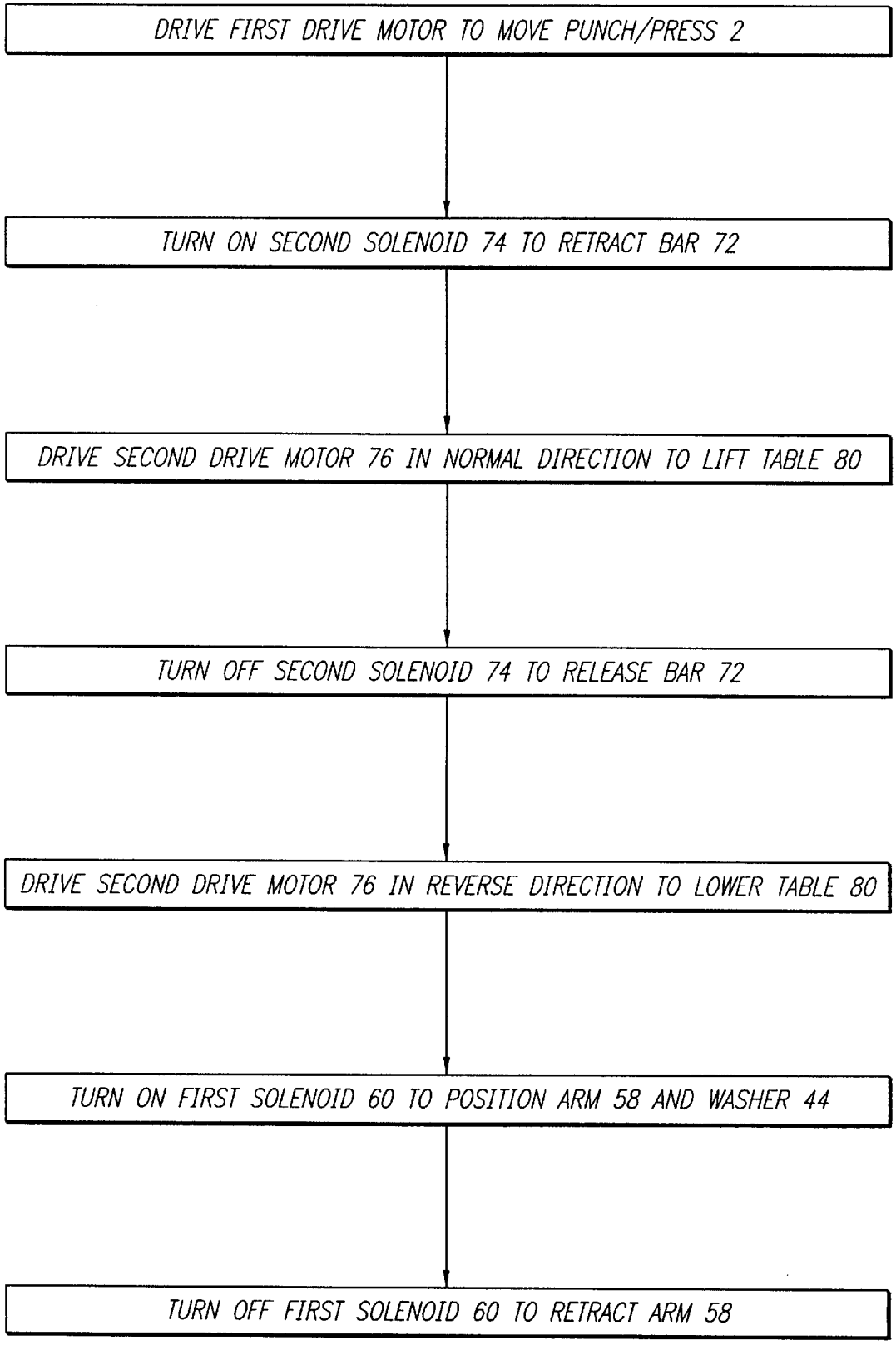
FIG. 9 is a flow chart illustrating the control operation of a control unit included in the press machine in accordance with the present invention.
Figure 10:
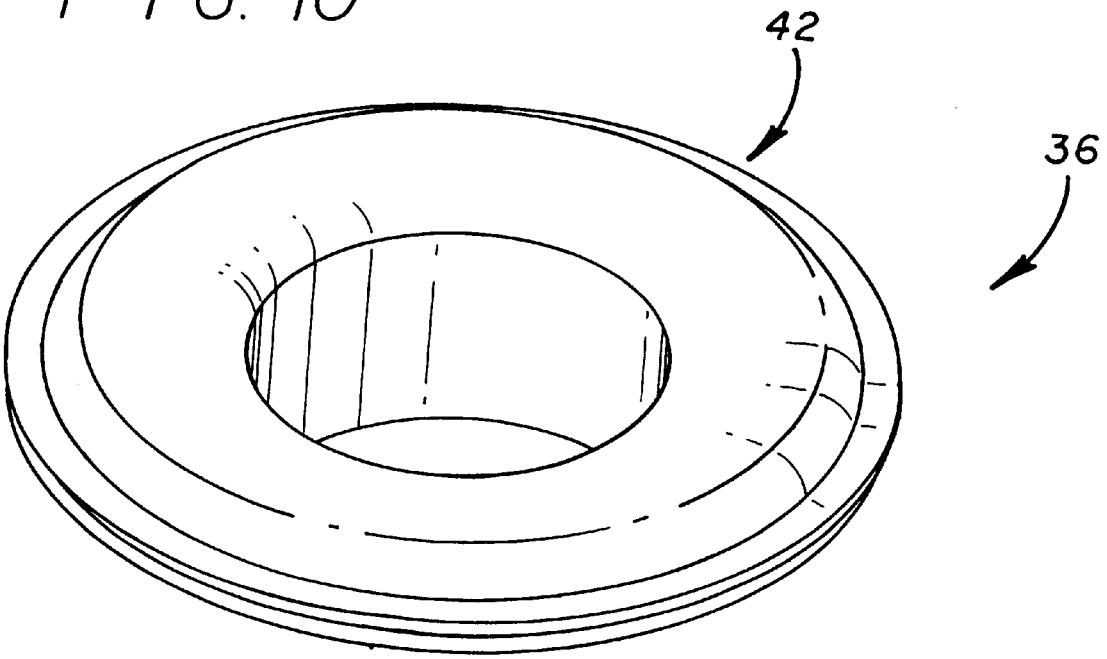
FIG. 10 is a top perspective view of the eyelet of the present invention.
Figure 11:
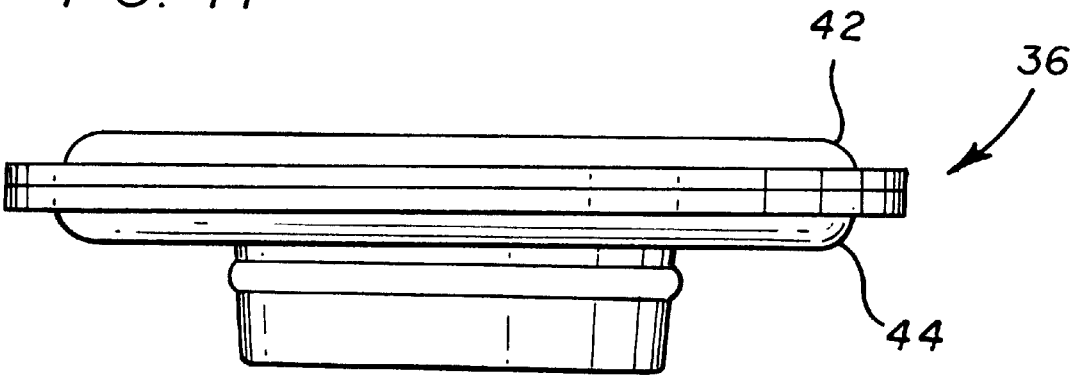
FIG. 11 is a front plan view of the eyelet of FIG. 10.
Figure 12:
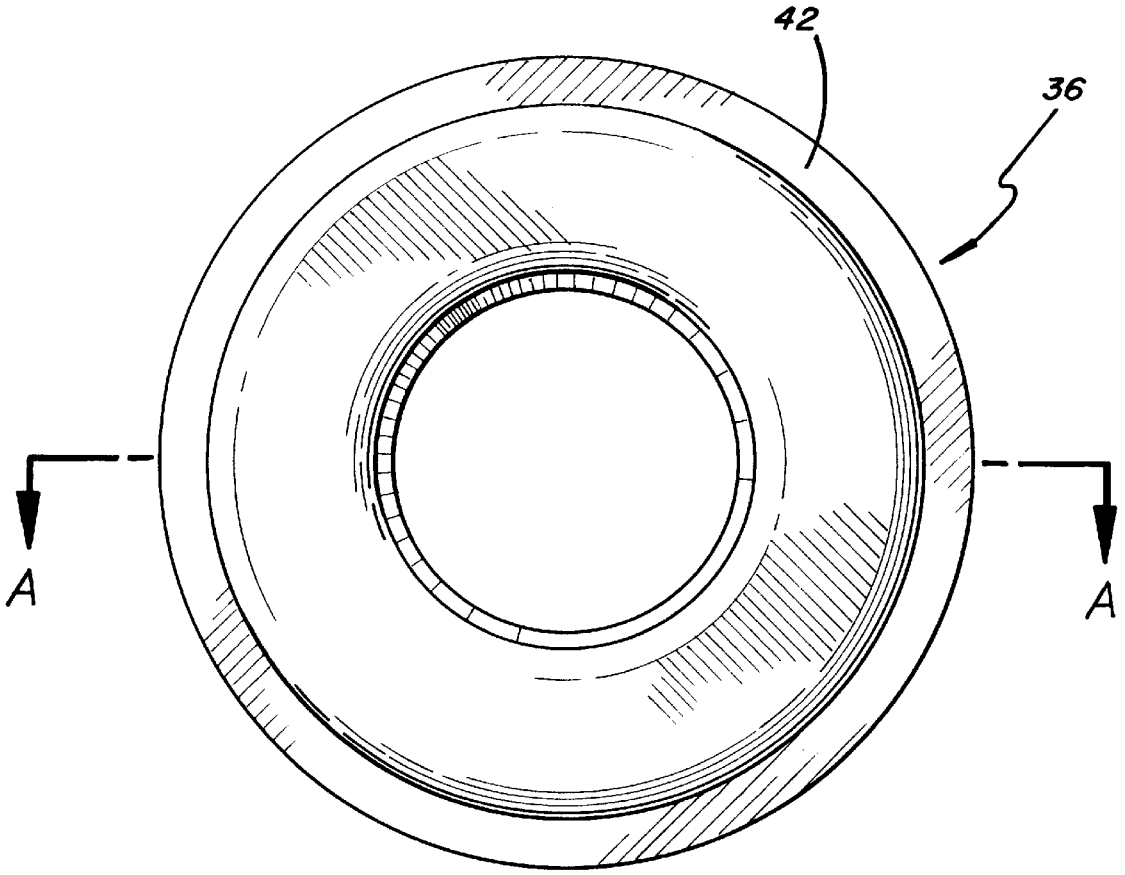
FIG. 12 is a top plan view of the eyelet.
Figure 13:
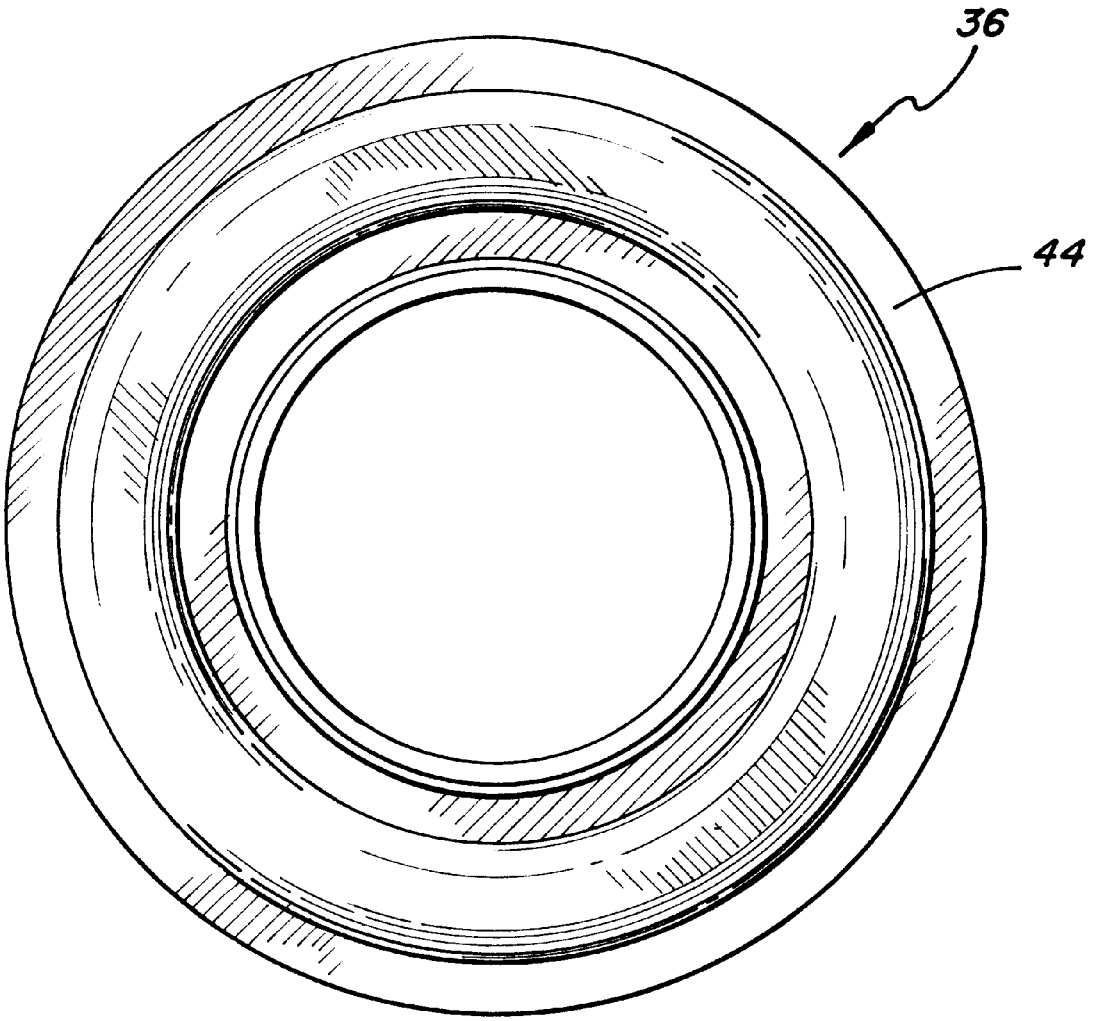
FIG. 13 is a bottom plan view of the eyelet.
Figure 14:
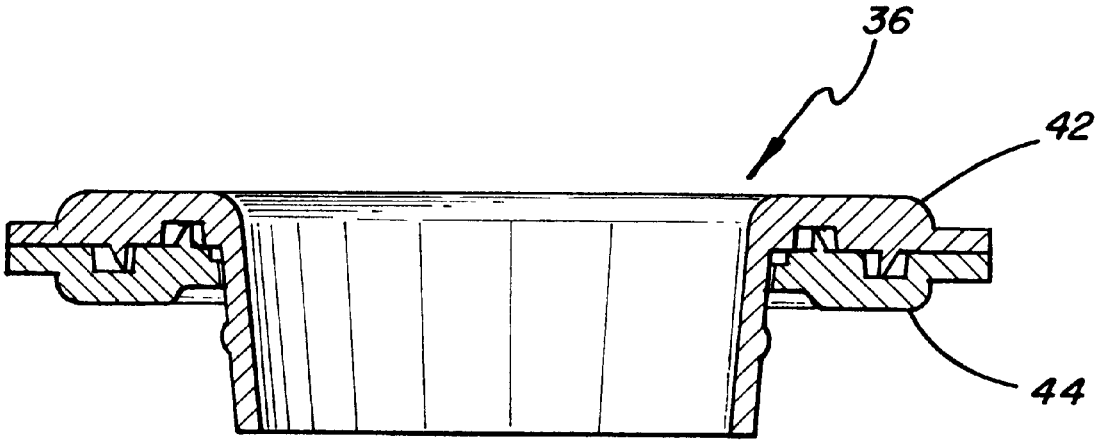
FIG. 14 is a cross-sectional view of the eyelet taken along line A—A of FIG. 12.
Figure 15:
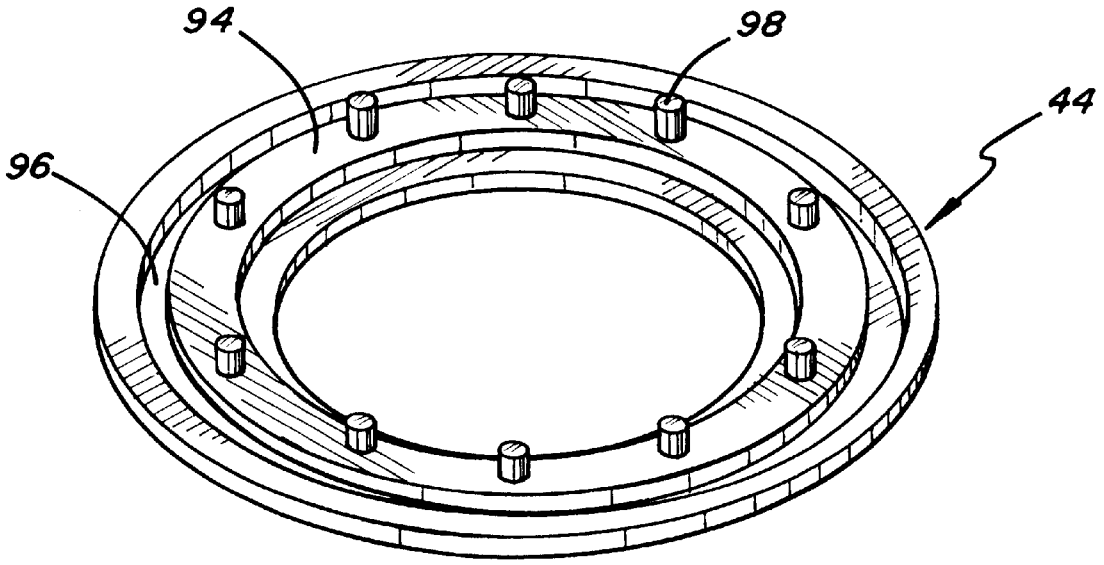
FIG. 15 is a top perspective view of a lower washer ring of the eyelet.
Figure 16:
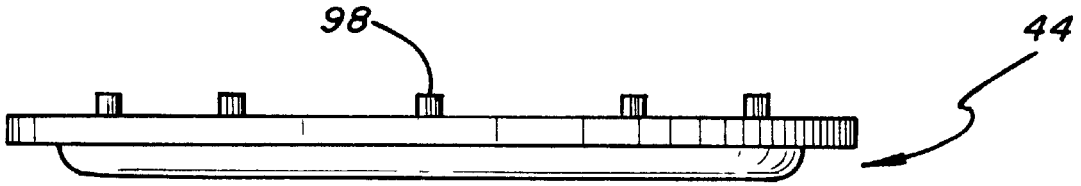
FIGS. 16 and 17 are side plan views of the lower washer ring of the eyelet.
Figure 17:
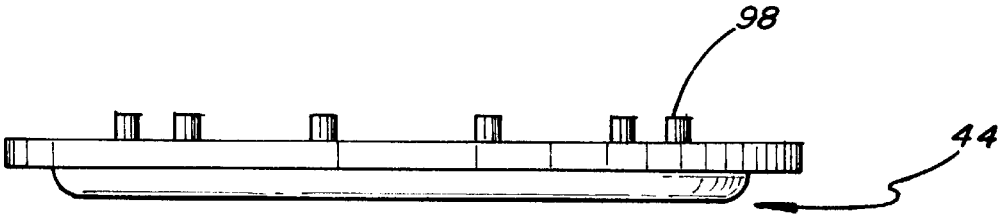
Figure 18:
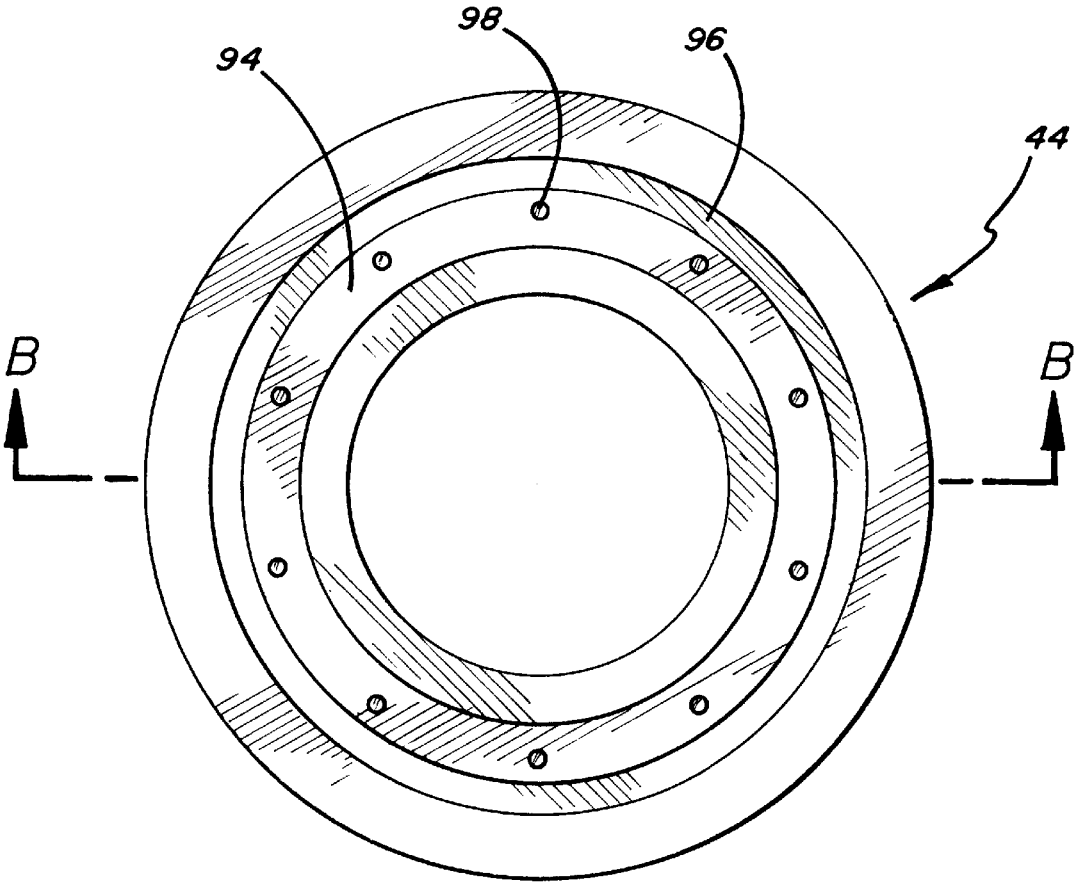
FIG. 18 is a top plan view of the lower washer ring of the eyelet.
Figure 19:
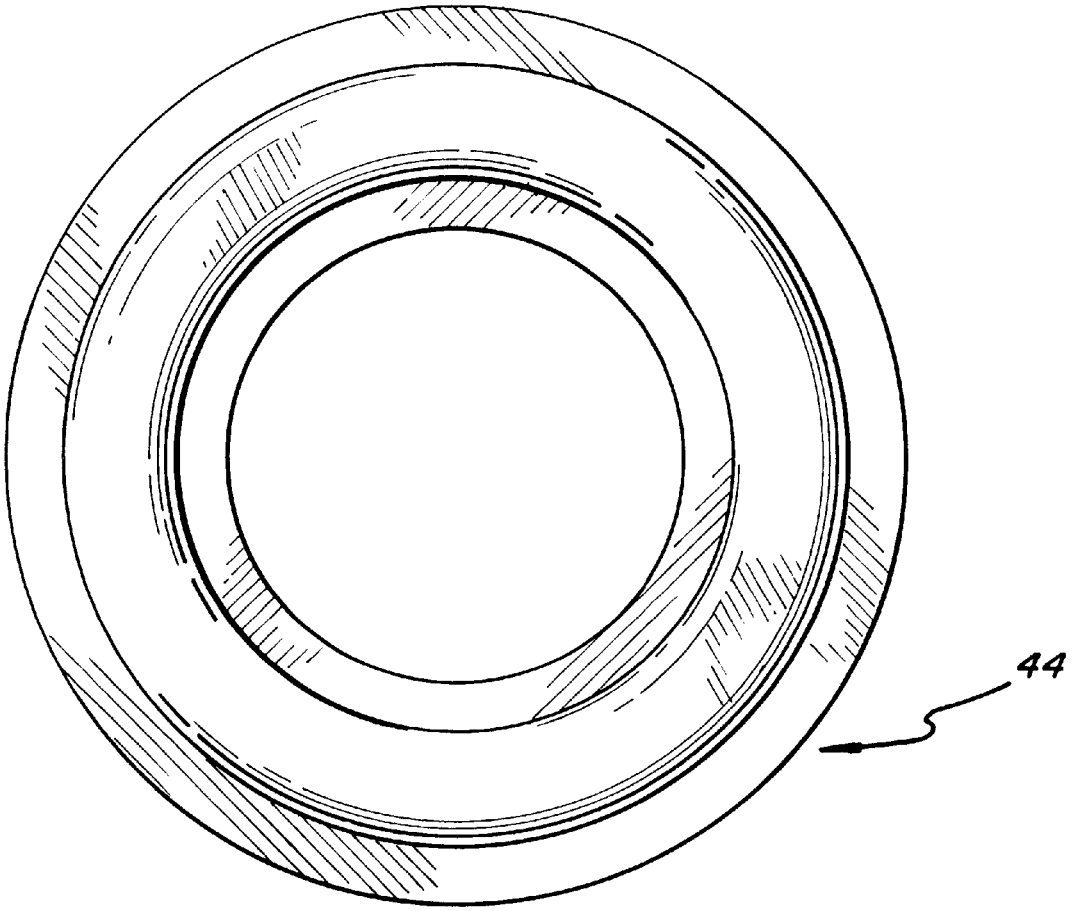
FIG. 19 is a bottom plan view of a lower washer ring of eyelet.
Figure 20:
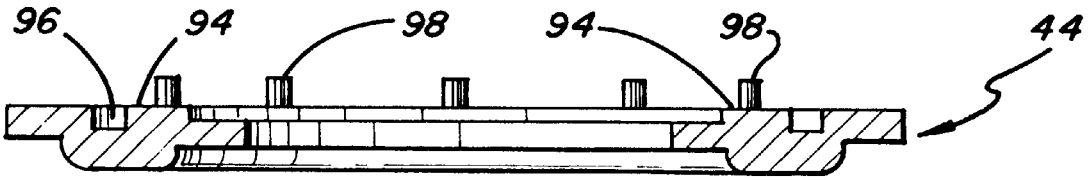
FIG. 20 is a cross-sectional view of the lower ring of eyelet of FIG. 18 taken along line B—B.
Figure 21:
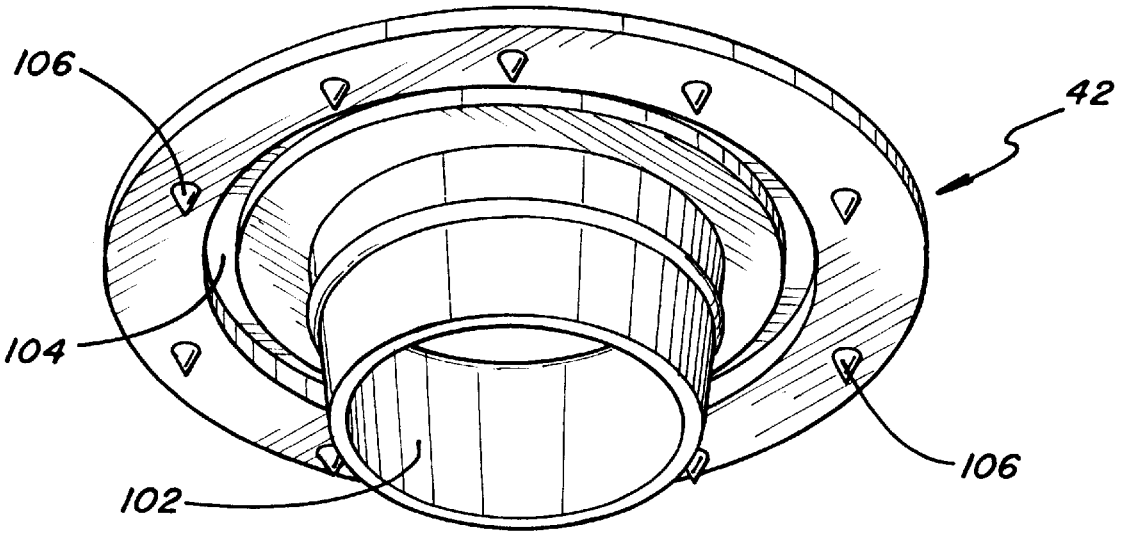
FIG. 21 is a bottom perspective view of the upper base ring of the eyelet.
Figure 22:
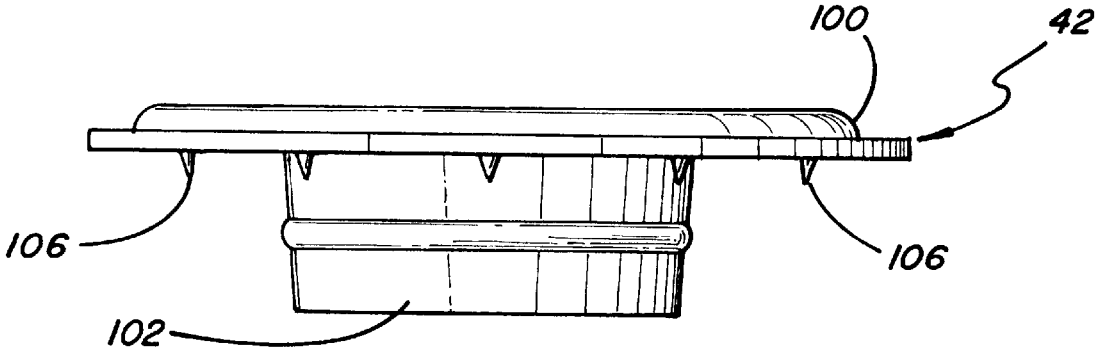
FIGS. 22 and 23 are side plan views of the upper base ring of the eyelet.
Figure 23:
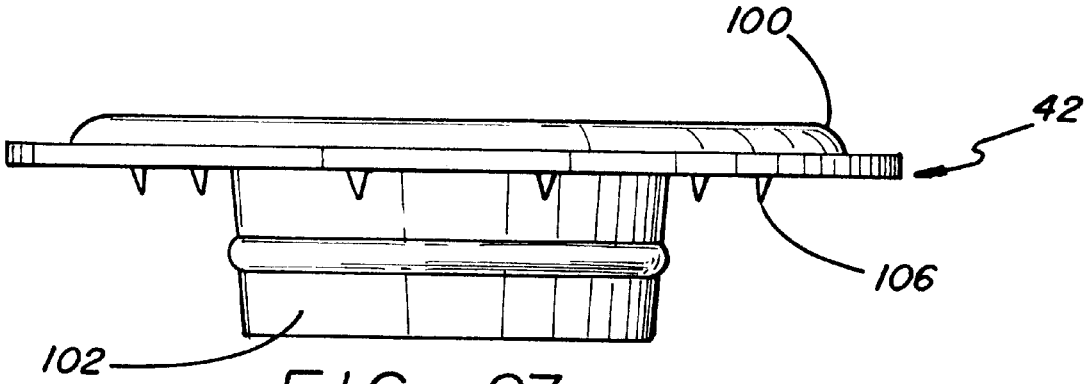
Figure 24:
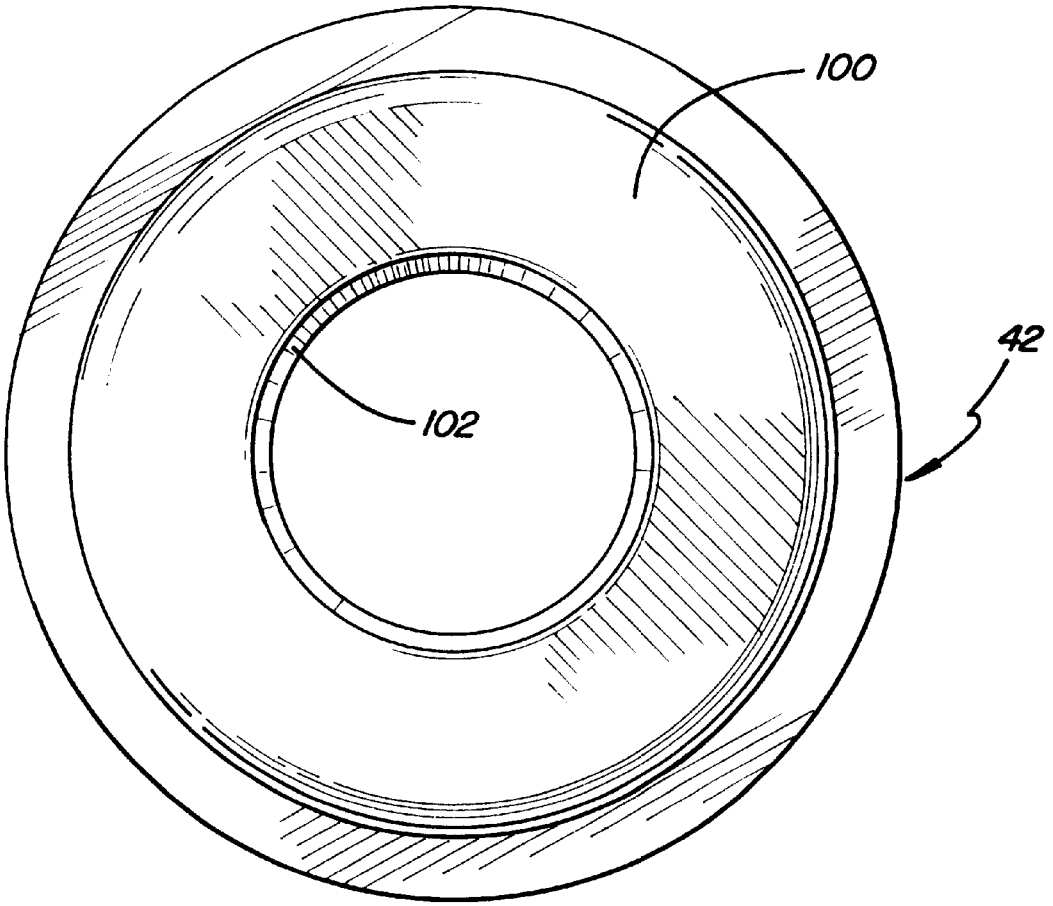
FIG. 24 is a top plan view of an upper base ring of the eyelet.
Figure 25:
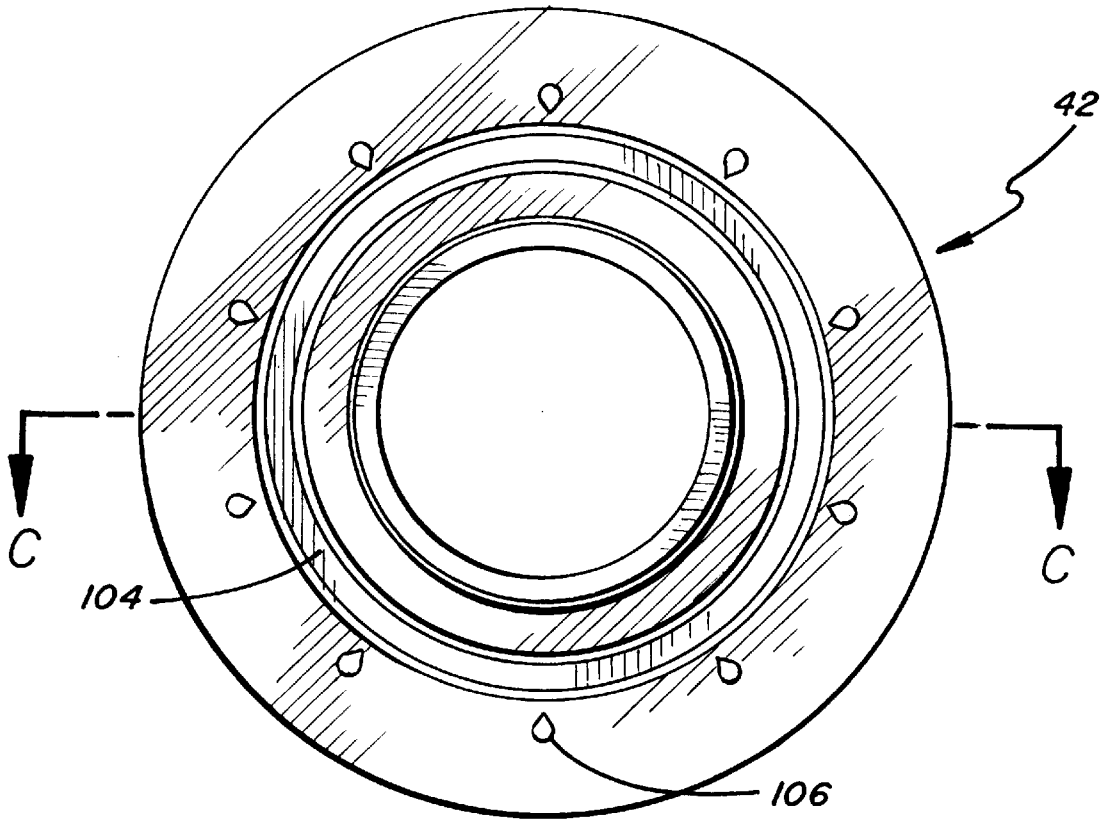
FIG. 25 is a bottom plan view of the an upper base ring of the eyelet.
Figure 26:
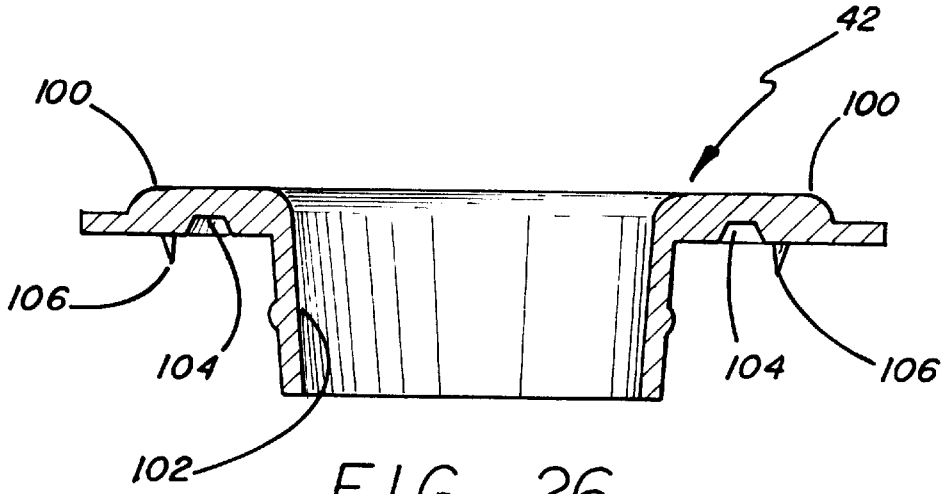
FIG. 26 is a side cross-sectional view of the upper base ring of the eyelet taken along line C—C of FIG. 25.
Figure 27:
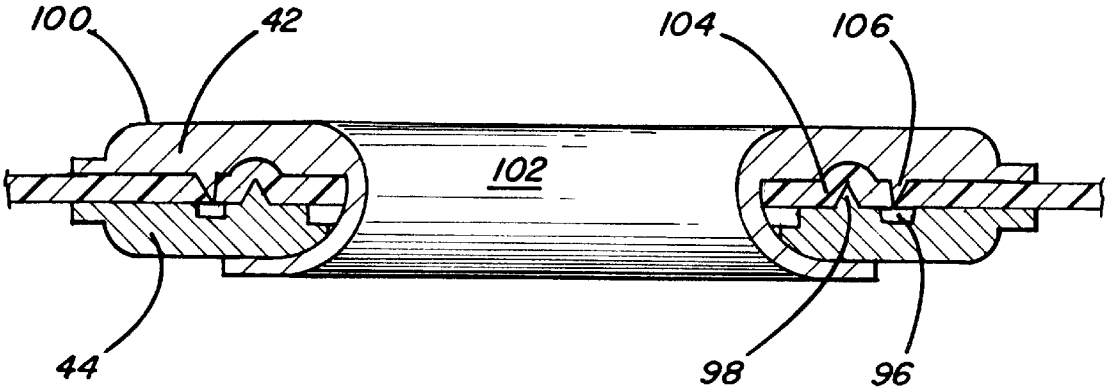
FIG. 27 is a side cross-sectional view of the eyelet when in use similar to that shown in FIG. 8*h*.

In response to the washer 44 reaching the table 80, the control unit 6 energizes the first solenoid 60, thereby rotating the arm 58 in such a fashion that the free end of the arm 58 comes into contact with the peripheral edge of the washer 44 in an urging state, as shown in FIG. 8*e*.

Figure 8F:
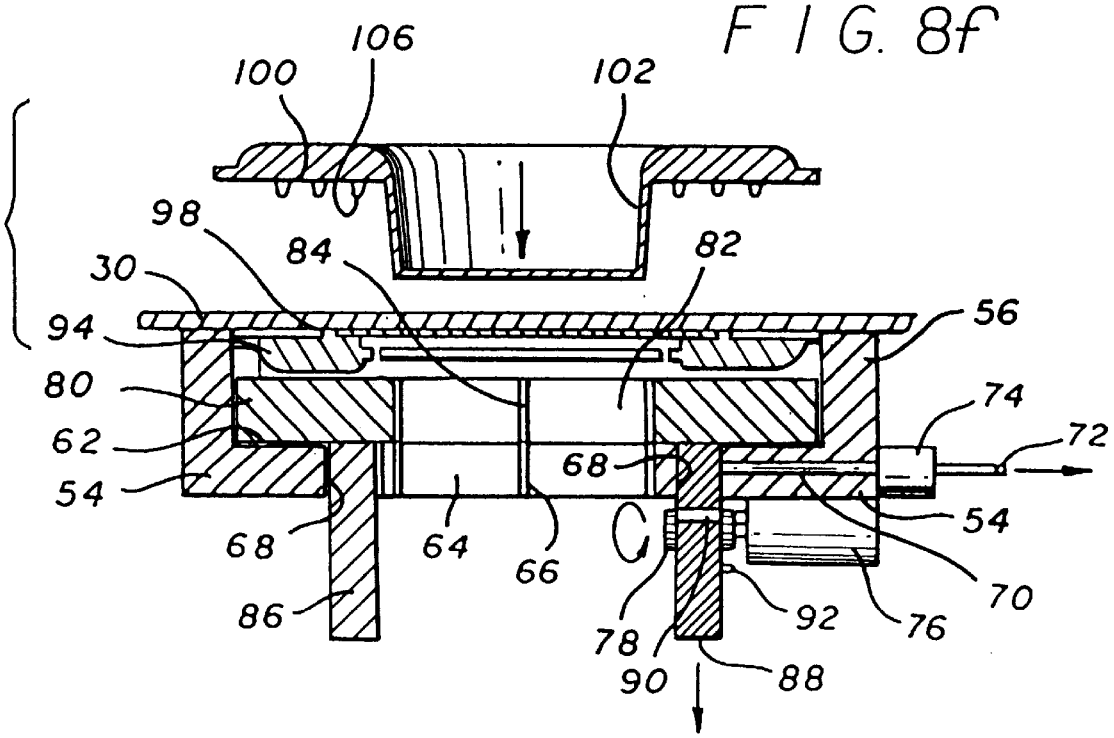

Thereafter, a base 42 is discharged from the second box 52 which operates in a vibrating manner. The discharged base 42 is downwardly fed to the die body 54 via the second chute 48 and then laid on the punched portion of the cloth 30 disposed over the table 80, as shown in FIG. 8*f*.

Figure 8G:
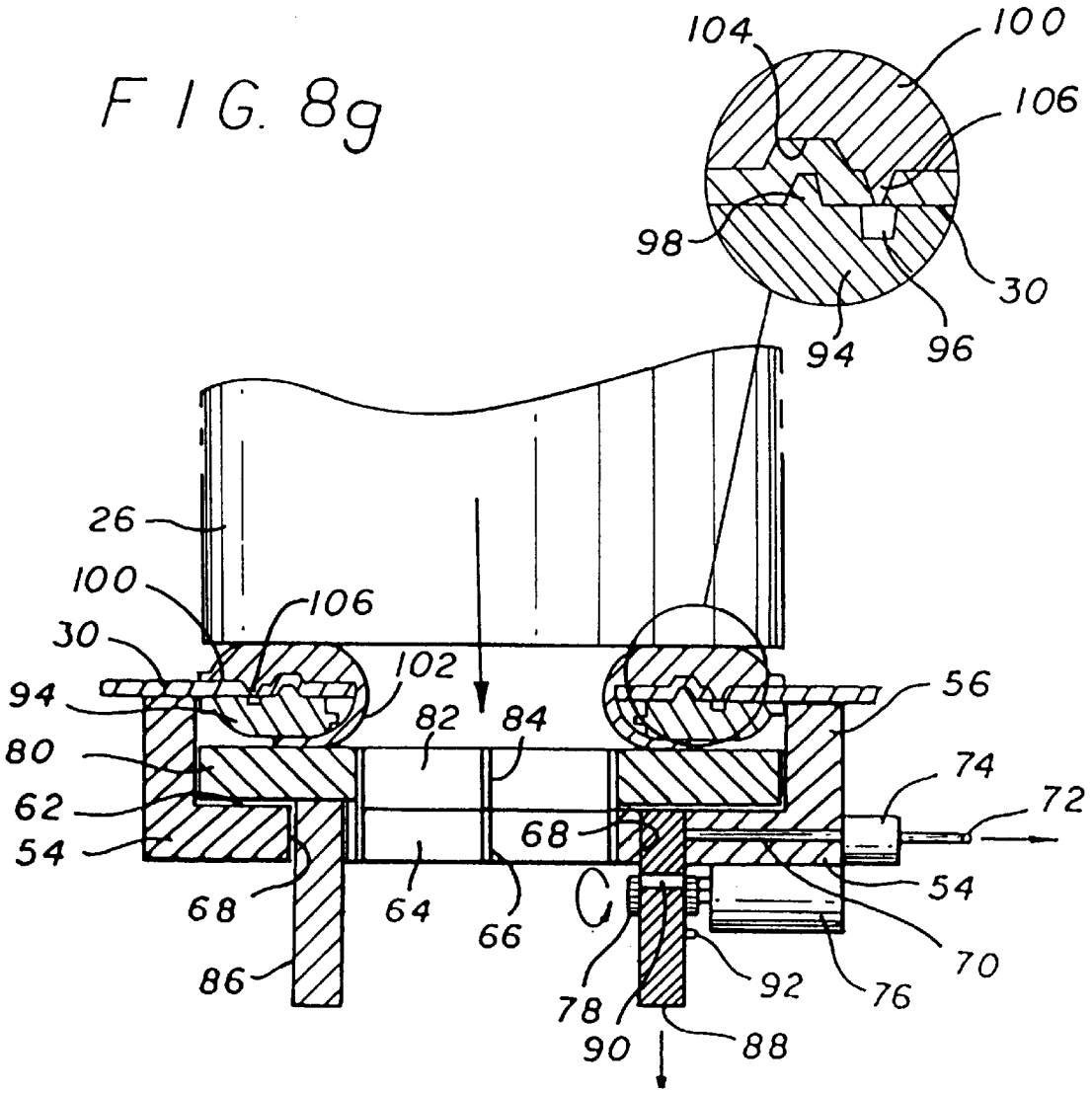

In this state, the locker 28 is adjusted so that it is positioned at its locking position where the punch 24 is locked with respect to the press 26. Accordingly, the punch 24 and press 26 move downwardly together by the drive force of the lever 20 transmitted thereto in the form of a downward movement force by virtue of the camming function of the cams 14 and 18 rotating continuously by the drive force from the first drive motor 8. As the press 26 moves downwardly, it depresses the upper surface of the base 42, as shown in FIG. 8*g*.

As a result, the boss 102 of the base 42 passes through the hole of the punched cloth 30 by the external force applied to the base 42. At this time, the cuts formed at the edge of the hole serve to allow the boss 102 to easily pass through the hole.

As the press 26 further moves downwardly, the lower end of the base 42 comes into contact with the upper surface of the table 80 and then penetrates between the lower surface of the washer 44 and the upper surface of the table 80 while being radially outwardly widened.

Figure 8H:
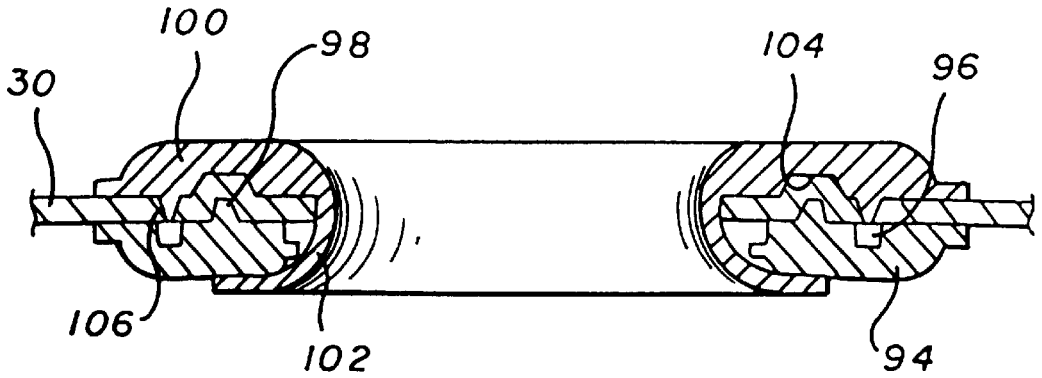

At this time, the washer 44 is slightly raised in the rest room 62 due to the lower end of the boss 102 penetrating between the lower surface of the washer 44 and the upper surface of the table 80. As a result, the upper surface of the washer 44 comes into close contact with the lower surface of the cloth 30, as shown in FIG. 8*h*. At this time, the pushing protrusions 98 formed on the washer 44 push the cloth 30 into the annular groove 104 of the base 42. Accordingly, the cloth 30 is firmly held by the washer 44.

The lower surface of the base 42 depressed by the press 26 also comes into close contact with the upper surface of the cloth 30. As a result, the prongs 106 are stuck in the cloth 30.

Thus, the prongs 106 of the base 42 and the pushing protrusions 98 of the washer 44 serve to firmly fix the eyelet 36 to the cloth 30 without any movement.

After completing the above operation, the press 26 and punch 24 return to their original positions by the drive force from the first drive motor 8 transmitted thereto in the form of an upward movement force by virtue of the camming function of the cams 14 and 18. Thereafter, the above-mentioned procedure is repeatedly carried out to attach further eyelets to the cloth 30.

As apparent from the above description, the present invention provides a press machine for attachment of eyelets which has a configuration capable of achieving attachment of an eyelet to a cloth using a single die with a table. Accordingly, it is possible to achieve an improvement in the efficiency of the eyelet attachment.

The present invention also provides an eyelet having a configuration capable of not only allowing the eyelet to be firmly attached to a cloth without being separated from the cloth due to an external force repeatedly applied to the eyelet or cloth, but also allowing the eyelet to be made of a material containing a large amount of polycarbonate. Accordingly, it is possible to eliminate the requirement of disposing the eyelet separately from the cloth upon disposal of the cloth and pollution of the environment caused by the eyelet disposed.

In accordance with the present invention, it is also possible to prevent the eyelet from damaging the cloth or the hand of the user when the cloth is folded for storage thereof.

The present invention has been described in an illustrative manner, and it is to be understood the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. An eyelet comprising:

an annular rim in close contact with an upper surface of cloth, to be attached with the eyelet, in an urging state, the annular rim defining a first groove;

a plurality of uniformly spaced prongs downwardly protruded from a lower surface of the rim and adapted to be stuck in the cloth, each of the prongs having a radially outwardly inclined shape;

a boss extending downwardly from an inner edge of the rim, the boss being fitted in a hole formed through the cloth;

a flange in close contact with a lower surface of the cloth, the flange defining a second groove;

a plurality of pushing protrusions upwardly protruded from an upper surface of the flange and arranged radially inwardly of the prongs, the pushing protrusions serving to push the lower surface of the cloth;

the first groove corresponding to at least one of the plurality of pushing protrusions, the first groove receiving at least one of the pushing protrusions across the cloth; and the second groove corresponding to at least one of the plurality of uniformly spaced prongs, the second groove receiving at least one of the prongs across the cloth; whereby the cloth is trapped between at least one of the pushing protrusions and the rim with the first groove and between at least one of the plurality of uniformly spaced prongs and the flange with the second groove.

2. An eyelet as set forth in claim 1, further comprising:

the boss engaging and holding the flange to the annular rim, trapping the cloth between the flange and the annular rim.

3. An eyelet as set forth in claim 2, further comprising:

the boss passing through the flange, the boss widened radially and outwardly to entrap the flange between the boss and the annular rim.

4. An eyelet as set forth in claim 3, further comprising:

at least one of either or both the boss and the flange being made substantially of polycarbonate.

5. An eyelet as set forth in claim 4, further comprising:

the first groove being annular;

the plurality of pushing protrusions being annular in arrangement and corresponding to the annular first groove;

the second groove being annular;

the plurality of uniformly spaced prongs being annular in arrangement and corresponding to the annular second groove;

the first groove and the plurality of pushing protrusions being offset from the second groove and the plurality of uniformly spaced prongs; whereby the cloth is forced aside from a plane of the eyelet in two directions, the eyelet better trapping the cloth thereby.

6. An eyelet comprising:

an annular rim in close contact with an upper surface of cloth, to be attached with the eyelet, in an urging state, the annular rim defining an annular first groove;

a plurality of uniformly spaced prongs downwardly protruded from a lower surface of the rim and adapted to be stuck in the cloth, each of the prongs having a radially outwardly inclined shape, the plurality of uniformly spaced prongs being annular in arrangement;

a flange in close contact with a lower surface of the cloth, the flange defining an annular second groove;

the annular second groove corresponding to the annular plurality of uniformly spaced prongs, the second groove receiving the annular plurality of uniformly spaced prongs across the cloth and trapping the cloth between the annular plurality of uniformly spaced prongs and the flange with the annular second groove;

a plurality of pushing protrusions upwardly protruded from an upper surface of the flange and offset radially with respect to the prongs, the pushing protrusions serving to push the lower surface of the cloth, the plurality of pushing protrusions being annular in arrangement and corresponding to the annular first groove;

the annular first groove corresponding to the plurality of pushing protrusions, the annular first groove receiving the pushing protrusions across the cloth and trapping the cloth between the pushing protrusions and the rim with the annular first groove;

the radial offset between the annular first groove and the plurality of pushing protrusions with respect to the annular second groove and the plurality of uniformly spaced prongs forcing the cloth aside from a plane of the eyelet in two directions, the eyelet better trapping the cloth thereby;

a boss extending downwardly from an inner edge of the rim, the boss being fitted in a hole formed through the cloth, the boss engaging and holding the flange to the annular rim, trapping the cloth between the flange and the annular rim, the boss passing through the flange and widening radially and outwardly to entrap the flange between the boss and the annular rim; and at least one of either or both the boss and the flange being made substantially of polycarbonate.

* * * * *